United States Patent [19]

Scheuchzer et al.

[11] 4,000,699

[45] Jan. 4, 1977

[54] APPARATUS FOR REPLACEMENT OF RAIL TRACKS

[75] Inventors: Fredy Scheuchzer, Lausanne; Fritz Bühler, Ecublens; Alfred Chiesa, Lucerne, all of Switzerland

[73] Assignee: Les Fils d'Auguste Scheuchzer S.A., Switzerland

[22] Filed: Jan. 24, 1975

[21] Appl. No.: 543,863

[30] Foreign Application Priority Data

| | | |
|---|---|---|
| Jan. 29, 1974 | Switzerland | 1158/74 |
| May 27, 1974 | Switzerland | 7207/74 |

[52] U.S. Cl. ..... 104/2; 104/3; 104/6; 104/137; 105/215 R

[51] Int. Cl.[2] ..... E01B 29/02

[58] Field of Search ..... 104/2, 4, 5, 6, 33, 104/3, 137, 243; 105/215 R

[56] References Cited

UNITED STATES PATENTS

| | | | |
|---|---|---|---|
| 3,654,868 | 4/1972 | Plasser et al. | 104/2 |
| 3,699,894 | 10/1972 | Plasser et al. | 104/2 |
| 3,808,693 | 5/1974 | Plasser et al. | 104/33 |
| 3,880,084 | 4/1975 | Denenburg | 104/33 |

FOREIGN PATENTS OR APPLICATIONS

| | | | |
|---|---|---|---|
| 2,228,196 | 1/1973 | Germany | 104/3 |
| 549,692 | 5/1974 | Switzerland | 104/2 |

*Primary Examiner*—Robert J. Spar
*Assistant Examiner*—Randolph A. Reese
*Attorney, Agent, or Firm*—Robert E. Burns; Emmanuel J. Lobato; Bruce L. Adams

[57] ABSTRACT

A train assembly for replacement of an old rail track by a new one with long rails comprises a permanently coupled train section including an open-frame wagon with rails carrying gantries for removal of track panels through the open frame and placing new cross-ties. The open-frame wagon has a bogie able to run on the track but retracted during operation and replaced by caterpillar tracks running on the ballast, or by rollers running on the new rails placed temporarily beside the track. The new rails are then brought together and fixed on the newly-placed cross-ties, so that the rear part of the train assembly runs on the new track whereas the front part runs on the old track.

11 Claims, 9 Drawing Figures

APPARATUS FOR REPLACEMENT OF RAIL TRACKS

BACKGROUND OF THE INVENTION

The invention relates to the replacement of old rail tracks by new ones, and is particularly concerned with the laying of relatively long new rails.

In a known method of replacement, gantries are mounted on the ground or on temporary tracks laid outside the cross-ties, these gantries are used to pick up rail sections and place them on a train. This involves complicated maneuvers, and the gantries have a high center of gravity which leads to instability, and hence an element of insecurity. Furthermore, there is a lack of room to place the new long bars or rails close beside the old track.

It has already been suggested to use a train assembly itself carrying a railway for the gantries or other lifting means. Such a device comprises two rows of rails carried by several linked wagons and forming along the length of the linked wagons a continuous railway for at least one gantry including means for lifting a rail panel (i.e. a unitary rail and cross-tie assembly, forming a section of the old track) through an opening of sufficient size in an open-frame wagon, and transporting the rail panels to another wagon where they are piled. This known device is suitable for the replacement of old panels by new panels of the same uniform and relatively short length, but involves difficulties for replacement by long rails, since whereas for normal, short new rail lengths the front section of the train assembly can run on the old track and the rear section on the new track, without difficulty, the laying of long new rails implies an excessive wheel base, i.e. between the last bogie running on the old track and the first bogie running on the new track.

SUMMARY OF THE INVENTION

An object of the invention is to remedy this drawback.

The rail-track replacement apparatus according to the invention is characterized in that the front of the train assembly is equipped to run on the old track and the rear is equipped to run on the new track. An intermediate section of the train assembly has an undercarriage including auxiliary support means for supporting the intermediate train section at least indirectly on the underlying base surface during movement of the intermediate train section over parts of the base surface from which panels of the old track have been removed. It is thus possible to provide a sufficient length of the intermediate train section to enable the laying of long rails. Said undercarriage also includes a retractable bogie able to run on the old (or new) track when the apparatus is not operating to lay new track.

The train assembly also preferably includes a series of gripping rollers forming means for lifting up and separating long rails laid beside the old track, then bringing them together to the desired uniform spacing and placing them on newly laid cross-ties to form the new track.

BRIEF DESCRIPTION OF THE DRAWINGS

Several embodiments of the invention will now be described in detail with reference to the accompanying schematic drawings, in which.

DESCRIPTION OF THE PREFERRED EMBODIMENTS

Figure 1:
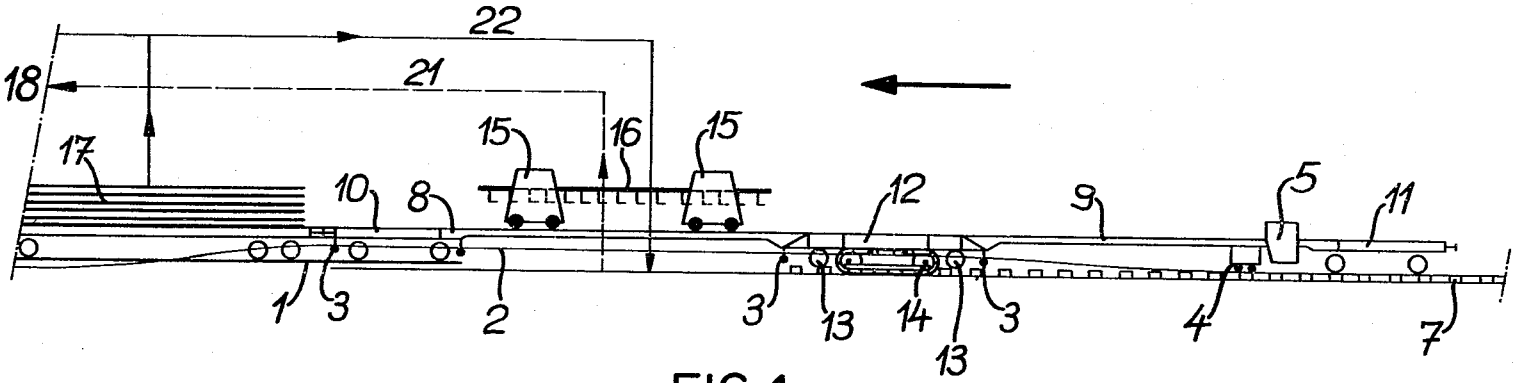
FIG. 1 is a side elevational view of an apparatus according to the invention, during a track replacement operation.

In the drawings, full arrowed lines indicate the paths of placing operations, and dashed arrowed lines the paths of removal operations.

Figure 2:
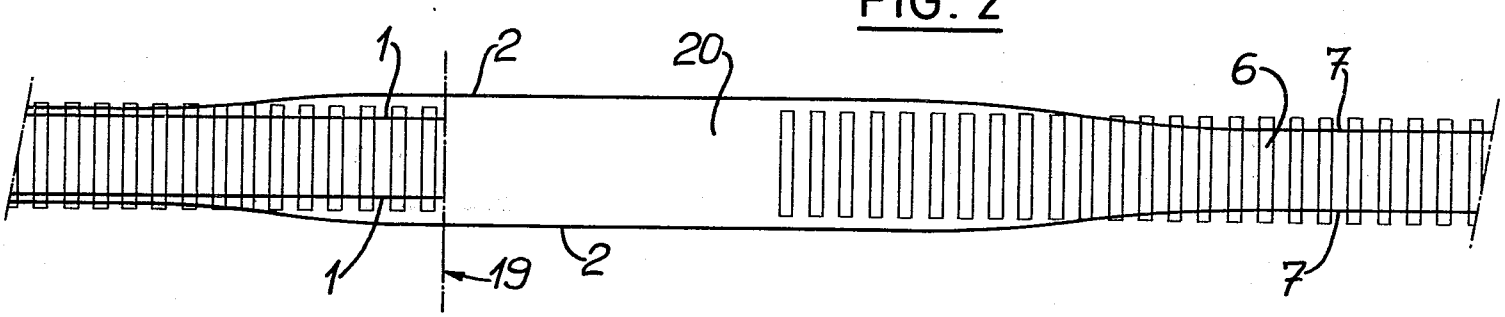
FIG. 2 is a plan view showing the track layout of FIG. 1 during the replacement operation.

With reference to FIGS. 1 and 2, 1 designates a stretch of old rails, 2 new long rails laid beside the old track and which are lifted up and spaced apart by roller grippers 3, then moved together again and lowered by rollers 4 to form a new track of rails 7 on new cross-ties 6. The roller grippers are controlled from a cabin 5.

The train assembly comprises two open-frame wagons 8 and 9 with a front bogie 10, a rear bogie 11, and an intermediate bogie 12 whose wheels 13 can be retracted during operation and replaced by a caterpillar-track chassis 14. The train assembly forms a permanently coupled unit and carries a pair of rails extending along the length thereof and on which a pair of gantries 15 can run. FIG. 1 shows the gantries 15 carrying a removed panel 16 of the old track, for delivery to a wagon 18 (see FIG. 5); the gantries 15 can also carry a cross-tie carrying girder to deliver sets of new cross-ties from a wagon 17.

In operation, the long new rails 2 are laid on either side of the old track 1. The front bogie 10 of wagon 8 runs on the old track 1, which ends at 19 (FIG. 2). The roller grippers 3 lift up and separate the long rails 2. A panel 16 removed from 20 is lifted up by the gantries 15 through the opening of the open-frame wagon 8, and is then delivered to a wagon 18, along the path indicated by 21. The same gantries 15, during the return run from wagon 18, pick-up a cross-tie carrying girder from wagon 17, and deliver it, along the path indicated by 22, through the open-frame of wagon 8 to place a set of cross-ties on the ballast, in the manner described in detail in Swiss Pat. No. 549,692. Of course, the cross-tie carrying beam can be complemented by a device, mounted in the open-frame wagon 9, for placing cross-tie one-by-one.

From the commencement of operation, the wheels 13 of intermediate bogie 12, which serve for light running, are moved to a raised withdrawn position and make way for the chassis 14 whose caterpillar-tracks run on the ballast outside the newly laid cross-ties. Bogie 11 runs on the new track, the entire train advances and grippers 4, controlled from cabin 5, move towards one another and lay the new rails with their normal spacing.

The open-frame wagon 9 and the gantry-supporting railway are described in Swiss Pat. No. 549,692. The retractable bogie is of a known type, as is the caterpillar-track chassis. The caterpillar tracks could be replaced by a set of wheels with pneumatic tires, or by articulated props moved by means of jacks. Whatever be the auxiliary support device used to move on the ballast, it will advantageously be provided with a steering system, and a motor for driving the train assembly.

In a varied embodiment of the invention shown in FIGS. 6 to 9, in which the same parts as in FIGS. 1 and 2 are designated by the same reference numberals, the intermediate bogie, which may be reduced to a single axle of the open-frame wagon, comprises pairs of wheels 13 with normal spacing and pairs of outer rollers 37 whose sparation can be adjusted to that of the two rows of new rails 2 laid beside the normal-width track. Jacks are provided for making either the wheels 13 or rollers 37 operative, and as well as a device for withdrawing or removing the rollers 37 for light running on the bogie wheels 13.

In this case, it will be advantageous to fix each of said rollers at the lower end of a jack 35, whose upper end is arranged in a slide 36 fixed to said bogie so that the spacing of the rollers 37 is adjustable to the width of the temporary track 2.

The bogie in question may in this variation form the terminal bogie of the permanently coupled front part of the train assembly, with gantry-carrying tracks 39 for removing track panels and placing cross-ties. One or several independent train sections or wagons (not shown) will be temporarily coupled behind said front part of the train assembly for bringing together the long new rails 2 (which have served as a temporary track supporting said rollers), and raising and fixing them onto the cross-ties 6.

The train assembly may also be equipped with a ballast clearing device, operating either transversely to evacuate ballast to the sides of the track or longitudinally by means of a bucket dredger and a conveyor conveying the ballast to the rear of the open-frame wagon 9 to once more be spread on the base surface. Such ballast clearing before placing new cross-ties is or may be necessary to avoid the new track being at a higher level than the old one.

Figure 5:
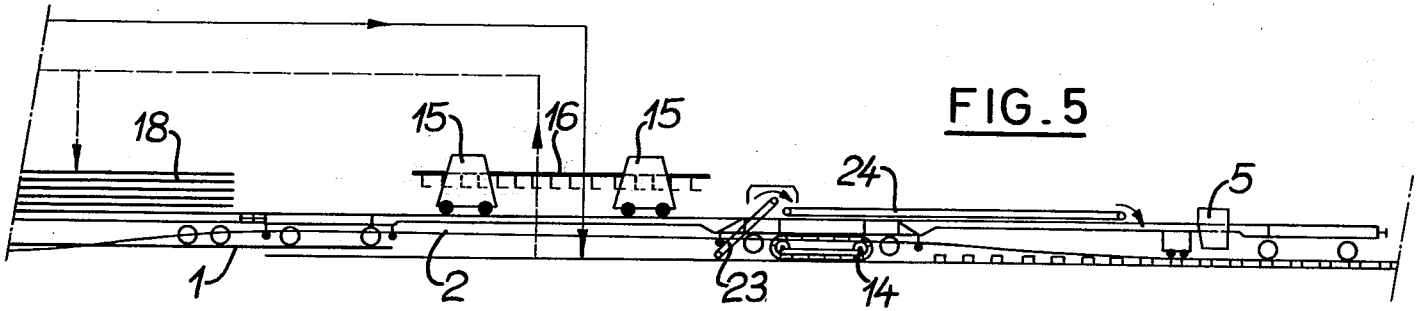
FIG. 5 is a side elevational view of another embodiment of the apparatus including a ballast clearing device.
Figure 6:
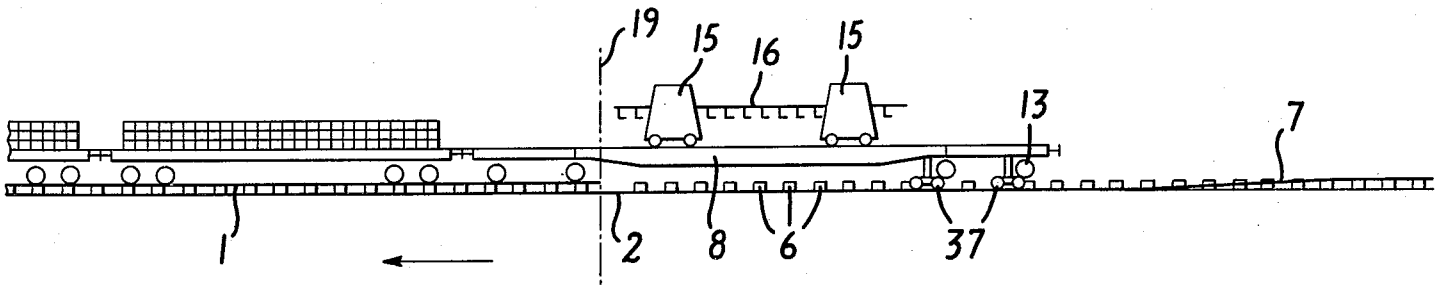
FIG. 6, is a side elevation view of another apparatus during a track replacement operation.
Figure 7:
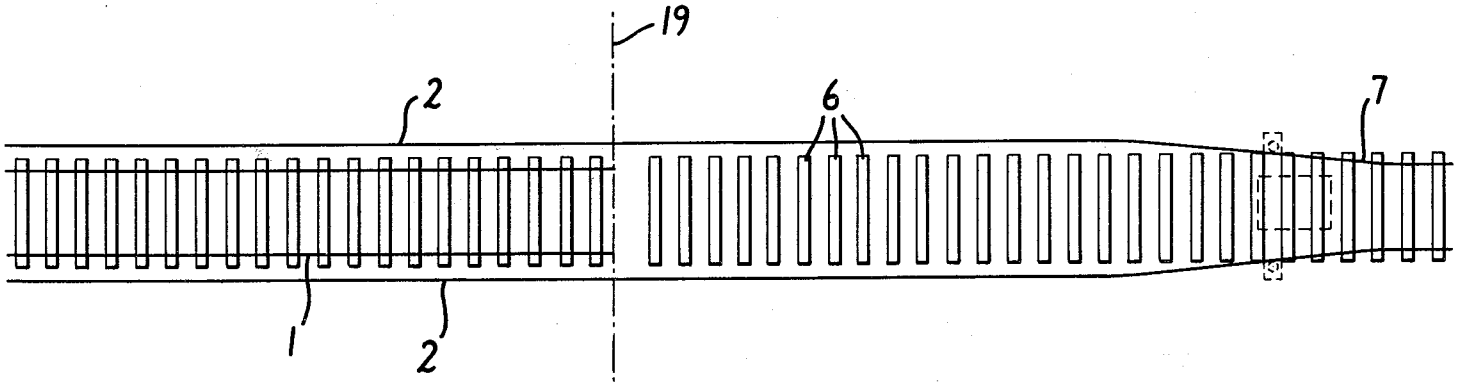
FIG. 7, is a plane of a diagram illustrating the replacement of tracks in FIG. 6.
Figure 8:
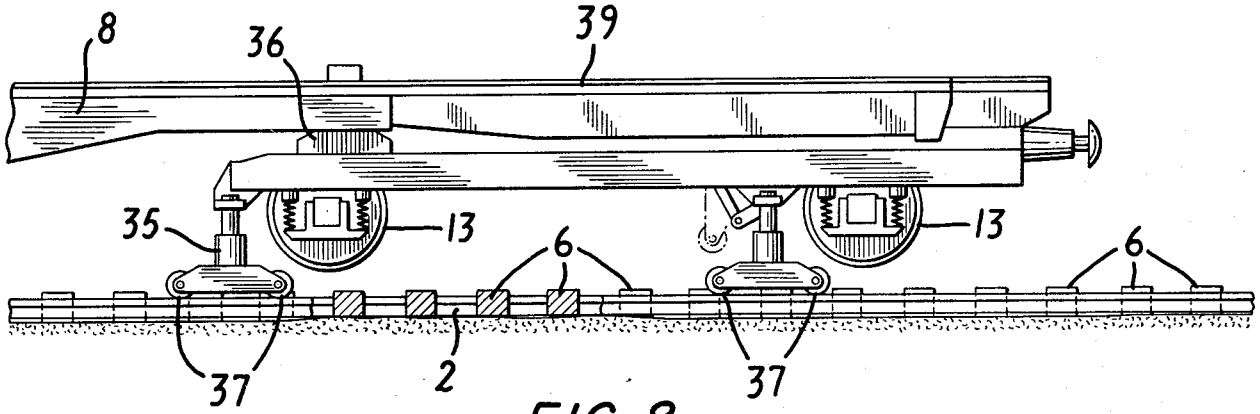
FIGS. 8 and 9 are side elevation of the right side and end views of the apparatus in FIG. 6.
Figure 9:
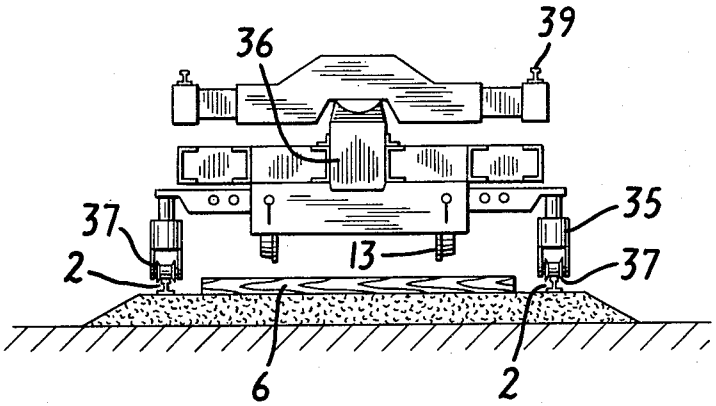

FIG. 5 shows the adjunction of such a ballast clearing device to the train assembly, namely a bucket dredger 23, and a conveyor 24. The remainder of the arrangement is the same as in FIG. 1, except that the wagon 18 receiving track panels 16 is shown connected just before the first open-frame wagon.

To accelerate the rate of operation, two complete or partial permanently-coupled train-assemblies may be coupled together. Also, the train assembly(ies) may be followed by a cross-tie bolt securing wagon 25 (FIG. 4) equipped with machines and tools for securing the new rails to the cross-ties.

Figure 3:
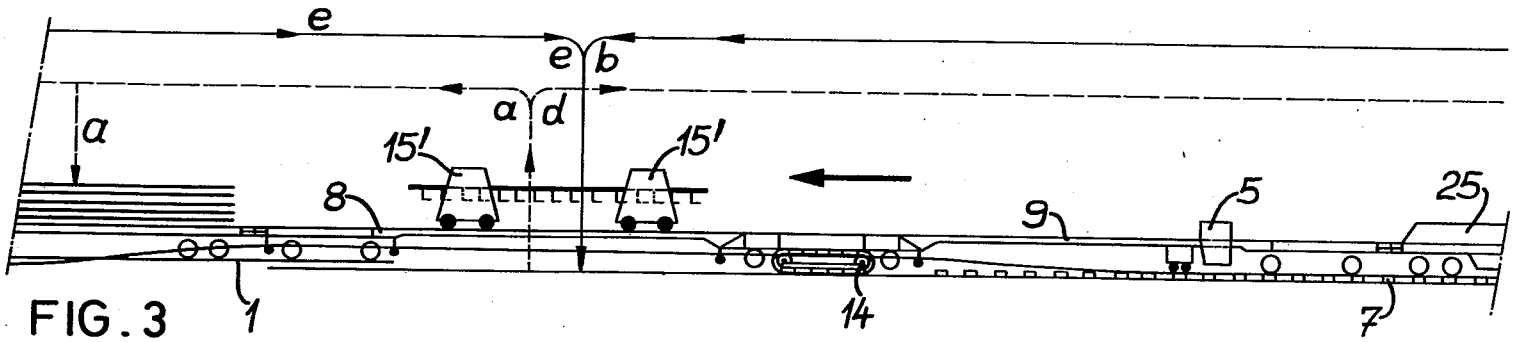
FIGS. 3 and 4 are side elevational views of the right and left hand parts of another embodiment of the apparatus during a track replacement operation.
Figure 4:
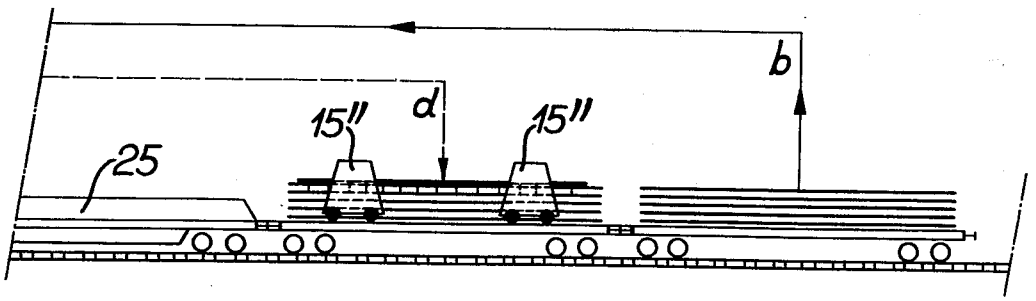

FIGS. 3 and 4 illustrate the simultaneous use of two pairs of gantries 15' and 15'' respectively, whose functions alternate. As mentioned, the full arrowed lines indicate the paths of placing operations, and dashed arrowed lines, the paths of removal operations.

Hence, while the first pair of gantries 15' carry a removed track panel to a forward wagon along path *a*, the second pair of gantries 15'' delivers (along path *b*) and places a corresponding number of new cross-ties. Then, after the train has advanced by the length of a track panel, and while the second pair of gantries 15'' removes and transports another track panel to a rear wagon along path *d*, the first pair of gantries 15' delivers (along path *e*) and places a new set of cross-ties.

By employing this arrangement and method, the idle time is reduced to a strict minimum, and the track replacement proceeds very rapidly, which is of capital importance for busy lines.

What is claimed is:

1. An apparatus for replacement of an old rail track disposed on an underlying bed surface by a new rail track, comprising a train assembly including a first train section having means for moving on old rail track, a second train section having means for moving on a new rail track, an intermediate train section linking the first and second train sections, means for removing panels of the old track from the bed surface, means for laying new cross-ties on the bed surface cleared of the old track to support rails of a new track, and means for placing and securing new rail sections longer than said removed track rails on said new cross-ties to form the new track, said intermediate train section comprising an open-frame wagon having means defining therein an opening through which said track panels can be lifted, said intermediate train section having an undercarriage including a retractable bogie able to run on the old rail track and auxiliary support means for supporting the intermediate train section at least indirectly on the underlying bed surface independently of the old track and of the secured new track during movement of said intermediate train section over parts of said bed surface from which panels of the old track have been removed.

2. An apparatus according to claim 1, in which said retractable bogie includes at least one pair of wheels spaced to run on the normal track, said auxiliary support means comprising at least one pair of rollers spaced to run on two rails formed by said new rail sections previously laid on said bed surface on either side of the old track, and comprising jack means for making either the wheels or the rollers operative.

3. An apparatus according to claim 2, including means for spacing said rollers adjustably.

4. An apparatus according to claim 3, in which each of said rollers is mounted on the lower end of a jack whose upper end is slidably mounted on said bogie transverse to the axis of the track.

5. An apparatus according to claim 2, in which said open-frame wagon is permanently-coupled to said first train section and includes rail means supporting gantries arranged to move on said rail means along said permanently coupled section of the train assembly, said retractable bogie forming a terminal bogie of said open-frame wagon and of said permanently coupled train section, said second train section being removably coupled to said open-frame wagon and carrying said means for placing and securing said new rail sections.

6. An apparatus according to claim 1, in which said auxiliary support means comprises articulated jack-actuated props able to move on said base surface.

7. An apparatus according to claim 1, in which said auxiliary support means comprises steering means.

8. An apparatus according to claim 1, in which said auxiliary support means comprises means for driving the train assembly.

9. An apparatus according to claim 1, in which at least a part of said train assembly including said open-frame wagon is permanently coupled and comprises rail means for supporting at least two pairs of gantries arranged to alternately lift and transport track panels and cross-ties.

10. An apparatus according to claim 9, in which said means for securing new rail sections is mounted in a separate coupled wagon.

11. An apparatus according to claim 1, in which the cross-ties are placed by a device mounted in said open-frame wagon.

* * * * *